US005322111A

United States Patent [19]

Hansma

[11] Patent Number: 5,322,111

[45] Date of Patent: Jun. 21, 1994

[54] CERAMIC LINED SHOT SLEEVE

[75] Inventor: Arnold Hansma, Burlington, Canada

[73] Assignee: A. H. Casting Services Limited, Burlington, Canada

[21] Appl. No.: 17,595

[22] Filed: Feb. 16, 1993

[51] Int. Cl.[5] ..... B22D 17/20

[52] U.S. Cl. ..... 164/312

[58] Field of Search ..... 164/312, 303, 314, 313, 164/315, 113

[56] References Cited

U.S. PATENT DOCUMENTS

| | | | |
|---|---|---|---|
| 3,664,411 | 5/1972 | Carver et al. | 164/312 |
| 3,672,440 | 6/1972 | Miura et al. | 164/314 |
| 3,685,572 | 8/1972 | Carver et al. | 164/312 |
| 4,733,715 | 3/1988 | Matsuzaki et al. | 164/312 |
| 5,010,946 | 4/1991 | Nogami et al. | 164/312 |
| 5,195,572 | 3/1993 | Linden, Jr. et al. | 164/312 |

FOREIGN PATENT DOCUMENTS

| | | | |
|---|---|---|---|
| 0278208 | 8/1988 | European Pat. Off. | 164/312 |
| 0009174 | 4/1978 | Japan | 164/312 |
| 0156660 | 12/1980 | Japan | 164/312 |
| 0104453 | 4/1989 | Japan | 164/312 |
| 0104459 | 4/1990 | Japan | 164/312 |
| 4244067 | 8/1992 | Japan | 164/312 |

*Primary Examiner*—P. Austin Bradley
*Assistant Examiner*—Erik R. Puknys
*Attorney, Agent, or Firm*—Patrick J. Hofbauer

[57] ABSTRACT

A lined shot sleeve for use in injection die casting molten metal is disclosed. The lined shot sleeve comprises an elongated main body portion including a first continuous inner wall surface defining a receptacle bore axially extending between a first end and a second end of the main body portion A first ingress port opens onto the continuous inner wall surface and adapted to provide for passage of the molten metal into the receptacle bore There is an elongated ceramic liner adapted for secure placement within the receptacle bore, the liner including a second continuous inner wall surface defining a cylinder bore axially extending between a first end and a second end of the liner and an exterior wall surface adapted for frictional contact with the first continuous inner wall surface. The first and second ends of the ceramic liner are generally coincident with the first and second ends of the main body portion. A second ingress port opens onto the exterior of the liner in register with the first ingress port and adapted to provide for passage of the molten metal into the cylinder bore. The elongated ceramic liner acts as a physical and thermal insulator to protect the first continuous inner wall surface of the main body portion from contact with the molten metal. The shot sleeve further comprises an end collar member adapted for secure attachment to the first end of the main body portion and the first end thereof being adapted for operative engagement with an injection die casting mold platen.

22 Claims, 3 Drawing Sheets

FIG.1.
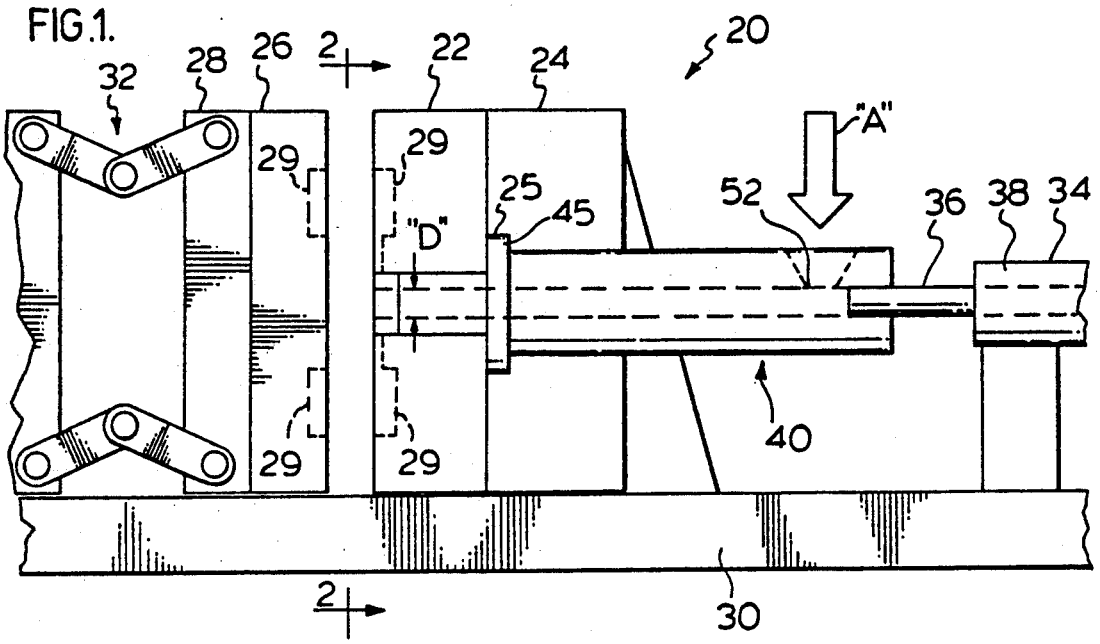
FIG.3.
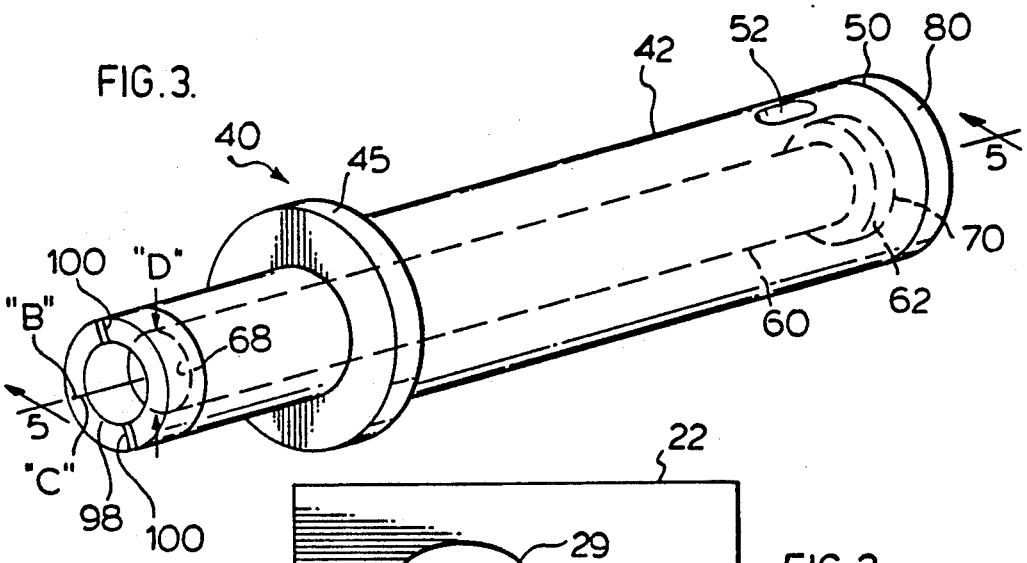
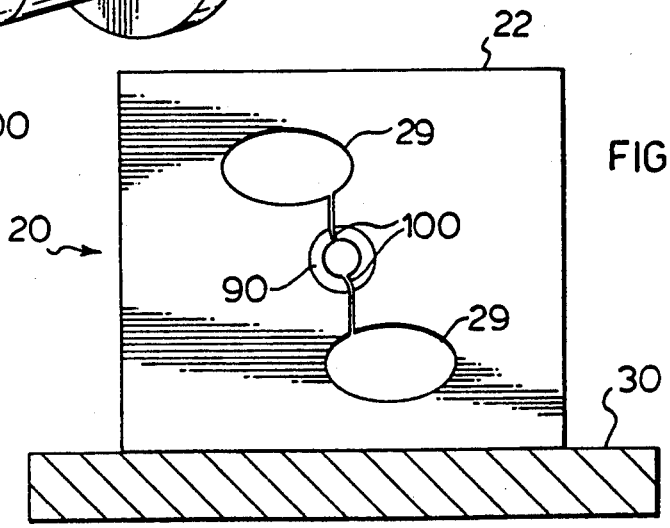
FIG.2.

CERAMIC LINED SHOT SLEEVE

FIELD OF THE INVENTION

This invention relates to the field of injection die casting equipment and more particularly to the shot sleeves incorporated into such equipment.

BACKGROUND OF THE INVENTION

Traditional equipment and methods for injection die casting of molten metal into molds are well known. Such metals would include aluminum, steel, wrought irons, brass, bronze and various exotic alloys, among others. In injection die casting machines, a metal shot sleeve is securely fitted to the mold platen in fluid communication with the mold cavity, as outlined more fully below. The shot sleeve extends outwardly from the mold platen and is adapted to receive the molten metal through an ingress port therein, which port is adapted to pass the molten aluminum into the mold cavity. Shot sleeves are typically anywhere from 24" to 48" in length and from 6" to 14" in diameter, and are typically made of a high-grade steel, such as H-13 grade steel, which steel is expensive. Further, the heat treating process used to harden steel requires high temperatures, which often causes the steel to warp. The shot sleeve has a cylinder bore extending the length thereof, which cylinder bore is typically circular in cross section, and is in fluid communication with the ingress port at one end and the mold cavity at the opposite other end. Further the cylinder bore of the shot sleeve must be machined to within tolerances of about 0.001" to about 0.002" in order to receive a cooperating piston in sliding relation therein, which machining is an expensive and time consuming operation. Resultingly, a typical shot sleeve may cost in the order of about $750.00 to about $4,000.00.

In use, a first end of the shot sleeve is entered into a mounting hole in the mold platen, to which platen it is securely fastened. The first end of the cylinder bore thus extends through the mold platen and connects through its open end to the cavity of the mold, which mold is securely mounted on the opposite side of the mold platen. The cylinder bore of the shot sleeve is in this manner mounted in the injection die casting machine in fluid communication with the mold cavity. Molten metal, which is typically about 1450° F., is then poured either by a robotically controlled ladle or a hand operated ladle into the cylinder bore of the shot sleeve through the ingress port. The molten metal starts to cool from its initial temperature of about 1450° F. as soon as it is introduced into the cylinder bore of the shot sleeve. It is important that the molten metal reach the mold while it is still fully molten in order to ensure the ultimate quality of the metal casting. A large amount of heat is transferred from the molten metal into the shot sleeve, largely because the shot sleeve is made of high-grade steel, which is a highly heat-conductive material. Such high heat loss is undesirable, since the amount of heat energy lost to the shot sleeve must be added to the original molten metal in the form of a higher initial temperature. Raising the initial temperature of the molten metal unnecessarily, especially over 1000° F., is undesirable since it is very expensive to heat metal, especially molten metal, past a temperature of about 1000° F. Indeed, the melting point of aluminum, for example, is in the order of 1200° C. Typical initial temperatures of molten aluminum, when prior art steel shot sleeves are used, are in the order of 1450° F. The extra heat energy above the melting temperatures is merely required to keep the metal in its molten state until it is in place in the mold cavity.

Due to cost considerations, it is typically required that the shot sleeves be able to withstand 40,000 shots of molten metal without failure or excessive wear. Prior art shot sleeves typically have a useful life expectancy of about 10,000 to about 15,000 shots maximum, since they are subjected to various harsh environmental conditions, such as exposure to corrosive materials at an extremely high temperature and pressure. This is mainly due to the fact that molten metal is very corrosive, because of additives such as silicon. Aluminum, as used for casting automotive parts, for example, has an especially high silicon content, which silicon causes the inner wall of the shot sleeve, which defines the cylinder bore, to eventually become corroded and, therefore, unusable. Further, when the molten metal is poured into the hollow core of the shot sleeve, the shot sleeve is subjected to very high thermal shock, which can eventually cause alterations to the material properties of the high-grade steel of the shot sleeve.

During the actual casting operation, there is a reciprocating piston situated in sliding relation within the cylinder bore of the shot sleeve. Before the molten metal is poured into the shot sleeve, the piston is retracted to the second end of the shot sleeve, which is the end opposite to the mold cavity. After the shot sleeve has been filled with molten metal, the piston is advanced along the cylinder bore of the shot sleeve in order to push the molten metal into the mold cavity under pressure. During such advancement of the piston, molten metal pressures in the order of about 6,000 PSI to about 14,000 PSI, are encountered in the shot sleeve. In order to: retain the molten metal within the cylinder bore of the shot sleeve; preclude the molten metal from escaping past the piston; and, retain the high pressure within the shot sleeve and mold, the piston is adapted to functionally seal against the inner wall defining the cylinder bore of the metal shot sleeve. Thus, the inner wall must be machined to within tolerances of about 0.001" to about 0.002", and must remain within a very small amount of its original shape and size throughout its useful life. Since a conventional steel shot sleeve does not remain within very close tolerances for more than about 10,000 to about 15,000 shots, which is significantly shorter than the life expectancy of a mold, the shot sleeve would need to be replaced at least once during the life of the mold. Such replacement is undesirable since the down time of the die casting machine during replacement and the labour to replace a shot sleeve are very costly. Typically, a mold must be cooled considerably from its operating temperature of between about 300° and about 400°, which can take several hours, so as to be safe to work on. The mold must be heated up to operating temperature. It is not uncommon for the "down time" required to change a shot sleeve and all of the necessary related other parts to be in the order of 8 hours. Such down time and labour is considerable, having regard to the amount of disassembly required, and further including the removal of coolant lines. Further, prior art shot sleeves are costly, as mentioned previously, up to about $4000.00.

The sealing of the piston against the inner wall defining the cylinder bore creates relatively high friction therebetween, which necessitates that a suitable lubricant, typically a graphite based release agent, be used on the piston. Due to the high temperatures of the molten metal, the lubricant is to a large degree burned off, which causes undesirable acrid smoke and fumes, which are considered a hazard from a worker health and safety standpoint. The inclusion of excess lubricant within the molten shot may also adversely impact upon the quality of the metal part being cast, due to impregnation of lubricant into the metal being cast. Further, any excess lubricant must eventually be disposed of, which is considered to be an environmental problem.

At the end of an injection molding cycle, it is common to have a portion of the molten metal solidify in the cylinder bore of the shot sleeve, adjacent the piston. This solidified portion is commonly referred to in the industry as a "biscuit". A biscuit is removed after each cycle by further advancement of the piston. The biscuit is usually reasonably tightly lodged in the first end of the cylinder bore of the shot sleeve, and resultingly there is a great deal of friction between the biscuit and the shot sleeve when the biscuit is pushed out by the piston. Resultingly, the first end portion of the inner wall of the cylinder bore of the shot sleeve (i.e. the position closest to the mold) is subjected to a great deal of wear during removal of the biscuit.

A further problem encountered in the use of prior art shot sleeves arises from the fact that it is often desirable to include radially extending fluid passageways, called "runners" in the first end face of the shot sleeve, where it fluidly connects as aforesaid with the mold cavity. Such runners are included to allow for increased flow of molten metal from the cylinder bore of the shot sleeve into the mold cavity, or into certain portions of the mold cavity. The use of runners is advantageous because it allows a mold to be filled more quickly and more evenly, and further allows the mold cavity to be more deeply recessed into the cover side of the mold, thus giving more latitude to the setting of a particular part into the mold. It is difficult and expensive to machine such runners into the first end face of the shot sleeve because of the large length and high mass of conventional shot sleeves, which makes handling difficult. Runners, although desirable, are frequently omitted from prior art shot sleeves because of the difficulty and expense to machine them. Certain types of parts are difficult to injection die cast without the inclusion of runners. It is also known that some types of exotic alloys are difficult to injection die cast without the inclusion of runners in the shot sleeve, which makes the die casting of these alloys extremely expensive. Further, in the event that the mold is to be changed before the shot sleeve is worn out, the shot sleeve must be changed anyway in order to allow for the inclusion of appropriate runners in the new shot sleeve. The shot sleeve must then be discarded, even though it is still functional.

One type of prior art shot sleeve that is directed towards solving some of the problems of earlier types of prior art shot sleeves is known as a "split sleeve" type shot sleeve. A split sleeve type shot sleeve is basically a two-piece shot sleeve radially bisected at the midpoint of its length. The two sections of the split sleeve are pinned together to form a fully functional shot sleeve. One section is attached to the mold platen and the other section extends outwardly from the mold platen and is removable from the retained section by removing pins or bolts that secure the two sections together. It is thereby possible to replace only the one section of the split sleeve furthest from the mold, often called the "back end" of the split sleeve, without replacing the other section of the split sleeve. This is desirable because the "back end" of the split sleeve, which contains the ingress port, is subjected to greater thermal shock and corrosion than is the other section of the split sleeve, and therefore typically becomes worn out earlier than the "front end" connected to the mold platen. Further, it is not necessary to disassemble the "front end" of the shot sleeve from the mold to replace the entire split sleeve, if only the "back end" needs replacing. A split sleeve type shot sleeve does, however, retain the aforementioned problems concerning heat transfer wear, and lubrication. Moreover, new problems are introduced with the use of split sleeve type shot sleeves. That is, the two sections of the split sleeve may not be entirely concentric with one respect to another within the 0.001" to 0.002" previously discussed. Such lack of concentricity causes premature wear where the piston meets the joint between the two halves of the cylinder bore of the shot sleeve. Also, lack of concentricity between the two cylinder bore halves can make it difficult to maintain a sealed relation between the piston and the inner wall of the hollow core of the shot sleeve in both halves of the cylinder.

It is therefore an object of the present invention to provide a shot sleeve for die casting machines that overcomes these and other related problems associated with prior art shot sleeves.

More particularly, it is an object of the present invention to provide a shot sleeve that reduces the amount of heat lost by the molten metal being cast while in the shot sleeve.

It is another object of the present invention to provide a shot sleeve that is more resistive to the corrosive action of molten metals than prior art shot sleeves.

It is a further object of the present invention to provide a shot sleeve that is more resistive to physical wear than prior art shot sleeves.

It is another object of the present invention to provide a shot sleeve that is more resistive to high thermal shock than prior art shot sleeves.

It is still a further object of the present invention to provide a multi-part shot sleeve that is easier and less expensive to maintain in standard operating conditions than prior art shot sleeves.

It is an object of the present invention to provide a shot sleeve that substantially reduces the need for using supplemental lubricants in the die casting process.

It is an object of a preferred embodiment of the present invention to provide a shot sleeve that comprises a removable and replaceable end collar means that is adapted to permit runners to be readily and easily machined therein for enhanced introduction of molten metal into a mold cavity, thereby allowing for increased design flexibility of molds.

It is another object of a preferred embodiment of the present invention to provide a shot sleeve that comprises a removable and replaceable end collar means that can be replaced independently of the need to replace the remaining components of the shot sleeve.

SUMMARY OF THE INVENTION

In accordance with the present invention, there is provided a lined shot sleeve for use in injection die casting molten metal. The lined shot sleeve comprises an elongated main body portion having a first longitudinal axis and including a first continuous inner wall surface defining a receptacle bore axially extending between a first end and a second end of the main body portion. A first ingress port opens onto the continuous inner wall surface and is adapted to provide for passage of the molten metal into the receptacle bore. An elongated ceramic liner is also provided, which liner is adapted for secure placement within the receptacle bore, the liner having a second longitudinal axis and including a second continuous inner wall surface defining a cylinder bore axially extending between a first end and a second end of the liner and an exterior wall surface adapted for frictional contact with the first continuous inner wall surface. The first and second ends of the ceramic liner are generally coincident with the first and second ends of the main body portion. A second ingress port opens onto the exterior of the liner in register with the first ingress port and is adapted to provide for passage of the molten metal into the cylinder bore. The elongated ceramic liner acts as a physical and thermal insulator to protect the first continuous inner wall surface of the main body portion from contact with the molten metal. The shot sleeve further preferably comprises an end collar means having a first end and a second end, with the second end thereof being adapted for secure attachment to the first end of the main body portion and the first end thereof being adapted for operative engagement with an injection die casting mold.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

FIG. 1 of the drawings appended hereto is a side elevational view of a typical injection die casting machine with a preferred embodiment of shot sleeve according to the present invention, installed thereon;

FIG. 2 of the drawings is a sectional view of the injection die casting machine and shot sleeve of the present invention taken along section line 2—2 of FIG. 1;

FIG. 3 is a perspective view of the shot sleeve of FIG. 1, removed from the injection die casting machine;

DETAILED DESCRIPTION OF A PREFERRED EMBODIMENT

Figure 4:
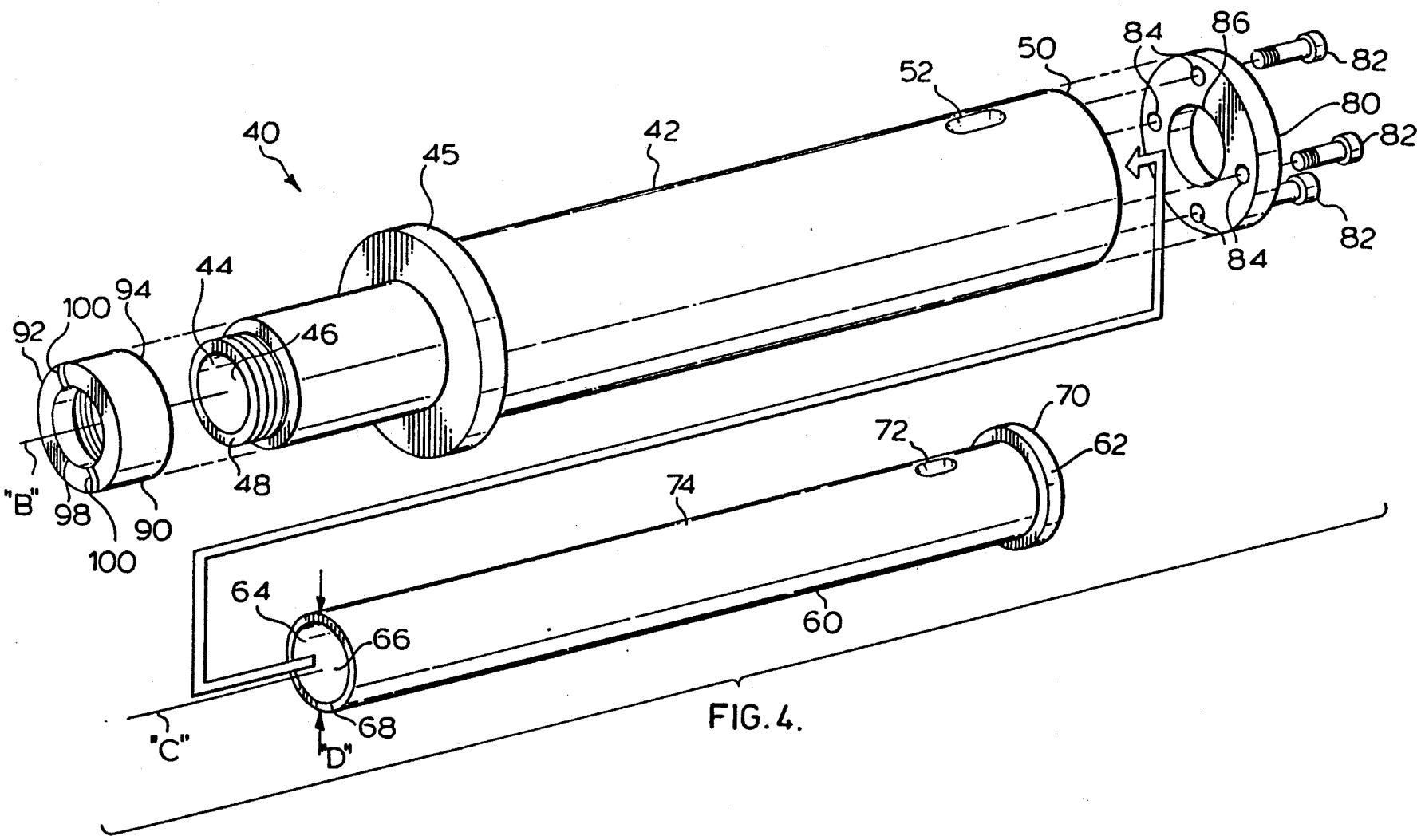
FIG. 4 is an exploded isometric view of the shot sleeve of FIG. 3.

Reference will now be made to FIG. 1, which shows an injection die casting apparatus, indicated by the general reference numeral 20, which may be a high pressure or low pressure type injection die casting apparatus. The injection die casting apparatus 20 retains a mold in operative relation thereon, which mold comprises a first mold half 22 and a second mold half 26. The first 22 and second 26 mold halves are secured by conventional means to a first mold platen 24 and second mold platen 28 respectively. The first mold half 22, first mold platen 24, second mold half 26 and second mold platen 28 are ultimately supported on a base member 30. The second mold half 26 and second mold platen 28 are moveable laterally along the base member 30 such that the second mold half 26 can be brought into its closed position where it is in intimate contact with the first mold half 22 during the injection molding operation. The second mold half 26 and second mold platen 28 may also be separated from the first mold half 22 after completion of one cycle of the molding operation so as to allow for ejection of the molded parts from the mold cavities 29. A closing mechanism 32, in the form of a pair of articulated arms on each side of the second mold platen 28 (only one pair shown), is used to move the second mold half 26 and second mold platen 28 into and out of its closed position in intimate contact with the first mold half 22. Securely retained by conventional fastening means within the first mold half 22 and first mold platen 24 is the lined shot sleeve of the present invention, which is indicated by the general reference numeral 40.

Also part of the injection die casting apparatus 20 is an advancing mechanism 34 including a piston 36 movably housed within a protective housing 38. The piston 36 is received in sliding relation within the lined shot sleeve 40, and is used to advance molten metal through the lined shot sleeve 40, as will be discussed in greater detail subsequently.

As shown in FIG. 1, the lined shot sleeve 40 of the present invention is disposed in a horizontal orientation. It is also possible to use the lined shot sleeve 40 of the present invention on injection die casting machines that have the shot sleeve to be disposed in a vertical orientation, such machines being known as "vertical die casting" machines. Further, the lined shot sleeve 40 of the present invention has a piston 36 that operates in conjunction therewith to push the molten metal into the mold cavity 29. It is also possible to use the lined shot sleeve 40 of the present invention on die casting machines that do not require such a piston, such as those which rely on gravity to feed the molten metal into the mold cavity.

Figure 5:
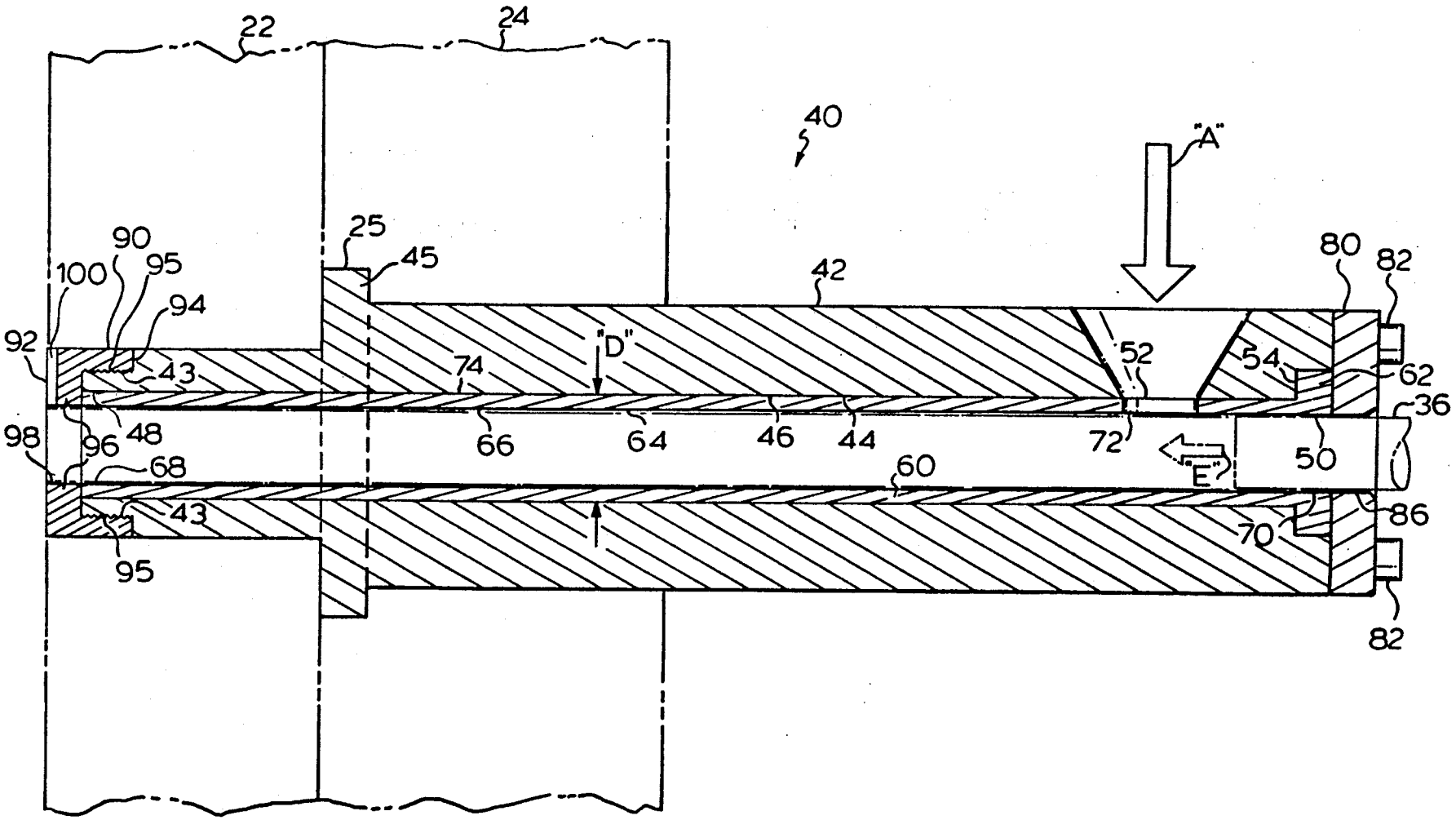
FIG. 5 is an enlarged cross sectional view of the shot sleeve of FIG. 3, taken along section line 5—5, with the mold platen and mold portions of the injection die casting machine and the piston of machine shown in ghost outline.

Reference will now be made to FIGS. 3, 4 and 5 in order to describe the lined shot sleeve 40 of the present invention in greater detail. The lined shot sleeve 40 comprises an elongated main body portion 42 having a first longitudinal axis generally designated by reference line "B" in FIG. 3. A first continuous inner wall surface 44 defines a receptacle bore 46 (see FIG. 4), which receptacle bore 46 is located generally centrally within the main body portion 42 and axially extends between a first end 48 and a second end 50 of the main body portion 42. The receptacle bore 46 is generally of a constant cross-sectional shape and size along its respective axial length, with the preferred cross-sectional shape being circular. There is a first ingress port 52 opening onto the continuous inner wall surface 44, which first ingress port 52 is adapted to provide for passage of molten metal into the receptacle bore 46. The first ingress port 52 is preferably disposed toward the second end 50 of the main body portion 42.

In order to preclude the main body portion 42 from coming out of the first mold half 22 and first mold platen 24, o which relative movement would be generally along the first longitudinal axis "B", a radially outwardly extending flange 45 is formed as an integral part of the main body portion 42. The flange 45 is adapted to be received in a co-operating recess 25 in the first mold platen 24.

An elongated ceramic liner 60 is adapted for secure placement within the receptacle bore 46 of the elongated main body portion 42. The elongated ceramic liner 60 is normally inserted into the receptacle bore 46 of the elongated main body portion 42 through the second end 50 thereof, as shown by the bent arrow in FIG. 4. When in place, the first 68 and second 70 ends of the ceramic liner 60 are generally coincident with the first 48 and second 50 ends of the main body portion 42. The elongated ceramic 60 has a second longitudinal axis "C" generally centrally located along the length of the ceramic liner 60. When the elongated ceramic liner 60 is in place in the receptacle bore 46 of the elongated main body portion 42, the first "B" and second "C" longitudinal axis are coincident, or at least, substantially parallel.

The elongated ceramic liner 60 includes a second continuous inner wall surface 64 that defines a cylinder bore 66, which cylinder bore 66 is located generally centrally within the elongated ceramic liner 60 and axially extends between the first end 68 and the second end 70 of the ceramic liner 60. The cylinder bore 66 is preferably of a constant cross-sectional shape and size along its axial length, with the preferred cross-sectional shape being circular. The elongated ceramic liner 60 also has an exterior wall surface 74 that is adapted for frictional contact with the first continuous inner wall surface 44 of the elongated main body portion 42. Preferably, the frictional contact is tight frictional contact, which is accomplished in the following manner. The outer diameter "D" of the exterior wall surface 74 of the elongated ceramic liner 60 is machined to within tolerances of about 0.001" to about 0.002" along its length and is about 0.004" greater than the diameter of the first continuous inner wall surface 44 of the receptacle bore 46. Resultingly, it is necessary to use a shrink fit type of operation to permit the insertion of the elongated ceramic liner 60 into the receptacle bore 46. This can be accomplished in one of two ways. Firstly, during operation of the injection die casting apparatus 20, the temperature of the elongated main body portion 42 is routinely elevated to anywhere between about 500° F. and 1450° F. Resultingly, the diameter of the elongated main body portion 42, and therefore the diameter of the receptacle bore 46 is enlarged up to perhaps 0.005", which would allow the elongated ceramic liner 60 to be readily inserted into the receptacle bore 46. Upon insertion of the elongated ceramic liner 60 into the receptacle bore 46, heat from the elongated main body portion 42 would be transferred to the elongated ceramic liner 60, which would cause the elongated ceramic liner 60 to expand to a diameter where it fits tightly into the receptacle bore 46. Alternatively, if the elongated main body portion 42 is not at an elevated temperature, the elongated ceramic liner 60 can be cooled to a very low temperature in order to insert the elongated ceramic liner 60 into the elongated main body portion 42.

It is preferable that the elongated ceramic liner 60 have a slightly higher coefficient of heat expansion than the main body portion 42, so that the ceramic liner 60 will expand tightly against the main body portion 42. This is important because the main body portion 42 is made from metal, and therefore expands slightly under the pressure of the injection casting process. The ceramic liner 60, however, does not expand under the pressure of the injection casting process, but tends to rupture if not sufficiently tightly supported around its perimeter. When the ceramic liner 60 is expanded to an increased diameter through increased heat expansion, it will tend to remain at a relatively constant tightness within the receptacle bore 46 of the elongated main body portion 42 as the temperature of the main body portion 42 and also increases. Conversely, the reverse situation occurs during decreases in temperature. Such increases or decreases in temperature occur during the normal operation of the injection die casting apparatus 20, especially when molten metal is poured into the cylinder bore 66 of the elongated ceramic liner 60.

The elongated ceramic liner 60 further comprises a radially outwardly extending flange 62 disposed at the second end 70 thereof. The flange 62 is adapted to preclude, in use, relative axial movement of the elongated ceramic liner 60 toward the first end 48 of the main body portion 42, by way of abutment against the shoulder 54 of the main body portion 42, and also is adapted to preclude, in use, relative axial movement of the elongated ceramic liner 60 toward the second end 50 of the main body portion 42, by way of abutment against an end plate 80, which end plate 80 will be discussed in greater detail subsequently.

The elongated ceramic liner 60 has a second ingress port 72 opening on to the exterior wall surface 74 of the ceramic liner such that the second ingress port 72 is in register with the first ingress port 52. The first ingress port 52 and second ingress port 72 are thereby adapted to provide for passage of molten metal into the cylinder bore 66.

In order to preclude relative movement of the elongated ceramic liner 60 toward the second end 50 of the main body portion 42, which relative movement would be generally along the first longitudinal axis "B", and thereby preclude the elongated ceramic liner 60 from moving out of the second end 50 of the main body portion 42, an end plate member 80 is removably securely engaged to the second end 50 of the main body portion 42, by way of appropriately threaded bolts 82 that pass through cooperating apertures 84 in the end plate 80 so as to be in secure threaded engagement with cooperating apertures (not shown) in the second end 50 of the main body portion 42. The end plate member 80 has a generally centrally located circular aperture 86 therein, which circular aperture 86 is adapted to receive the piston 36 in operative relation therethrough.

The lined shot sleeve 40 of the present invention further comprises an end collar means 90 having a first end 92 and second end 94. The second end 94 is adapted by way of a threaded portion 95 for secure attachment to the first end 48 of the main body portion 42, which has a co-operating threaded portion 43 located thereon at the second end thereof. The first end 92 of the end collar means 90 is adapted for operative engagement with the first mold half 22 and first mold platen 24 of the injection die casting mold. When the end collar means 90 is in place, the first end 68 of the elongated ceramic liner is generally covered and is thereby protected from physical damage. Further, the end collar means 90 is adapted to preclude relative axial movement of the elongated ceramic liner 60 toward the first end 48 of the main body portion 42 to thereby keep the elongated ceramic liner 60 securely retained within the main body portion 42. The end collar means 90 is adapted to withstand an internal pressure of 14,000 PSI and is formed of hardened high-grade steel, such as H13 grade steel, in order to withstand the thermal shock, corrosion and physical wear from the molten metal and the physical wear from the piston 36, as previously described herein. The end collar means 90 comprises an interference portion 96 that extends axially inwardly toward the first "B" and second "C"longitudinal axes. Interference portion 96 defines a terminal bore 98 of substantially the same diameter as the cylinder bore 66 of the elongated ceramic liner 60.

It is also possible for the end collar means 90 to comprise a second elongated ceramic liner therein, which second elongated ceramic liner would protect the end collar means 90 from physical and thermal damage in a manner generally analogous to the ceramic liner 60.

In the preferred embodiment illustrated, the end collar means 90 includes runners 100 therein. The number of runners in the end collar means 90 depends entirely upon design considerations of the mold halves 22, 26. There may be no runners, or there may be anywhere from one runner 100 to a large plurality of runners 100. The runners 100 can be seen in FIG. 2 to be in fluid communication with the cylinder bore 66 of the elongated ceramic liner 60 and in fluid communication with the mold cavities 29, 29 (see FIG. 2). The runners 100 are adapted to facilitate the axial flow of molten metal from the terminal bore 98 of the end collar means 90 to the mold cavities 29. In the event that a new mold is required before the shot sleeve requires changing, the entire collar means 90 may be replaced in order to facilitate the requirements of the new mold without changing the rest of the shot sleeve.

It is contemplated that the end collar means 90 can be made or machined to any length necessary, and further that the elongated main body portion 42 and the elongated ceramic liner 60 can therefore be dimensioned to relatively few standard lengths, thereby reducing the number of lengths of main body portions required to accommodate a wide variety of different makes and models of die casting machines. Resultingly, a smaller inventory of standard length elongated main body portions 42 and the elongated ceramic liners 60 can be maintained, which reduces overall production costs and also reduces the production time required to produce a quantity of shot sleeves particular to a specific make and model of die casting machine.

In operation, molten metal is poured into the cylinder bore 66 of the elongated ceramic liner of the lined shot sleeve 40 through the first ingress port 52 and second ingress port 72, as shown in FIG. 1 and in FIG. 5 at arrow "A". The molten metal flows partially along the cylinder bore 66 of the elongated ceramic liner 60. The elongated ceramic liner 60 protects the first continuous inner wall surface 44 of the elongated main body portion 42 from thermal shock, corrosion and physical wear. The ceramic liner 60 is less prone to thermal shock, corrosion and physical wear than is a common metal shot sleeve, and is also less costly to replace in the event that replacement is necessary, as only the liner itself, and perhaps the end collar 90 (described in more detail below) are required to be replaced. With prior art shot sleeves (not shown) the entire shot sleeve would have to be replaced. Further, the ceramic liner acts as an insulator, which causes the heat of the molten metal to be retained longer. Resultingly the initial temperature of the molten metal may be lower than with prior art shot sleeves to achieve the same desired quality control over the die cast parts (not shown) produced.

Once the molten metal has been introduced into the cylinder bore 66, the piston 36 is advanced along the cylinder bore 66 from the second end 70 to the first end 68 of the elongated ceramic liner 60, as shown by phantom arrow "E" in FIG. 5. The elongated ceramic liner 60 is by nature self-lubricating, which substantially precludes the need for supplementary lubricants, and also allows the piston 36 to slide relatively readily along the cylinder bore 66. The elongated ceramic liner 60 also protects the first continuous inner wall surface 44 of the elongated main body portion 42 from frictional damage from the piston 36.

As the piston 36 advances along the cylinder bore 66, it pushes the molten metal ahead of it, through the cylinder bore 98 and runners 100 of the end collar means 90, and thence into the mold cavities 29. Shortly thereafter, the molten metal hardens to form the desired die cast product. The second mold half 26 and the second mold platen 28 are then moved away from the first mold half 22 by the mold transport mechanism 32, so as to expose the molded product. Typically a portion of the molten metal remains in the terminal bore 98 of the end collar means 90 and hardens to form the biscuit, as previously described. The cylinder 36 is then advanced further to eject the biscuit from the terminal bore 98. The cylinder 36 may then be retracted to its initial position, as shown in FIG. 1, and a new injection cycle repeated.

In order to replace the elongated ceramic liner 60 in the elongated main body portion 42, the bolts 82 are removed from the end plate 80, the end plate 80 is removed from the second end 50 of the elongated main body portion 42, and the elongated ceramic liner 60 is slid along the second longitudinal axis "C", until it is removed from the elongated main body portion 42. In some cases, it may be necessary to also first remove the lined shot sleeve 40 from the first mold half 22 and first mold platen 24, and to then remove the end collar means 90 from the lined shot sleeve 40, in order to apply force to the elongated ceramic liner 60 at its first end 68.

Other embodiments of the present invention also fall within the scope and spirit of the claims presented herein. In one such alternative embodiment (not illustrated), it is contemplated that the lined shot sleeve 40 of the present invention may include a main body portion that is a split sleeve type. The ceramic liner of the invention as already described, would fit into the split sleeve type main body portion in the same general manner as described above, and would help overcome the presently known problems of properly concentrically aligning the two parts of the split sleeve.

I claim:

1. A lined shot sleeve for use in injection die casting of molten metal into a metal mold having first and second mold halves, with the first mold half mounted on a mold platen, said lined shot sleeve comprising:

an elongated main body portion having a first longitudinal axis and including a first continuous inner wall surface defining a receptacle bore axially extending between a first end and a second end of the main body portion, the elongated main body portion being adapted for secure, removable fitment of the first end within a corresponding recess of constant cross-section formed in the first mold half;

a first ingress port opening onto the continuous inner wall surface and adapted to provide for passage of said molten metal into said receptacle bore;

an elongated ceramic liner adapted for secure placement within said receptacle bore, said liner having a second longitudinal axis and including a second continuous inner wall surface defining a cylinder bore axially extending between a first end and a second end of the liner and an exterior wall surface adapted for frictional contact with said first continuous inner wall surface;

said first and second ends of the ceramic liner being generally coincident with said first and second ends of the main body portion;

a second ingress port opening onto the exterior wall surface of the liner in register with said first ingress port and adapted to provide for passage of said molten metal into the cylinder bore; and, an end collar means having a first end and a second end, with said second end thereof being dimensioned and otherwise adapted for secure releasable attachment to said first end of said main body portion and for fitment of said end collar means wholly within the confines of said corresponding recess without modification to said constant cross-section, said first end of the end collar means being further adapted for operative cooperation with said first mold half.

2. The lined shot sleeve of claim 1, further comprising an end plate member that is adapted for removable secure engagement to said main body portion at said second end thereof, and further adapted to preclude relative movement of said elongated ceramic liner toward said second end of said main body portion generally along said first longitudinal axis.

3. The lined shot sleeve of claim 2, wherein said first ingress port and said second ingress port are disposed toward the second ends of said respective elongated ceramic liner and said main body portion.

4. The lined shot sleeve of claim 3, wherein said first and second longitudinal axes are substantially parallel.

5. The lined shot sleeve of claim 4, wherein said cylinder bore of said elongated ceramic liner is adapted to receive a piston in close fitting sliding relation therein.

6. The lined shot sleeve of claim 5, wherein said end plate member is adapted to receive a piston rod in operative relation therethrough.

7. The lined shot sleeve of claim 6, wherein said receptacle bore and said cylinder bore are each generally circular in cross-sectional shape.

8. The lined shot sleeve of claim 7, wherein said receptacle bore and said cylinder bore are each of a generally constant respective diameter along the first and second longitudinal axes, respectively.

9. The lined shot sleeve of claim 8, wherein said elongated ceramic liner further comprises a radially outwardly extending flange disposed towards said second end thereof, said flange being adapted to preclude, in use, relative axial movement of said elongated ceramic liner toward said first end of said main body portion.

10. The lined shot sleeve of claim 1, wherein said elongated ceramic liner and said main body portion are manufactured such that the outer diameter of said exterior wall surface of the elongated ceramic liner is generally up to about 0.004" greater than the diameter of said first continuous inner wall surface of the receptacle bore, such that a shrink fit operation is required to permit the insertion of said elongated ceramic liner into said receptacle bore.

11. The lined shot sleeve of claim 1, wherein the material of said main body portion and said elongated ceramic liner have approximately the same co-efficient of heat expansion.

12. The lined shot sleeve of claim 1, wherein the first and second longitudinal axes are coincident.

13. The lined shot sleeve of claim 1, wherein said main body portion is of the split sleeve type.

14. The lined shot sleeve of claim 1, wherein, when said end collar means is in use, said first end of said elongated ceramic liner is generally covered and is thereby protected from physical damage.

15. The lined shot sleeve of claim 14, wherein said first end of said elongated ceramic liner and said first end of said main body portion are co-terminus.

16. The lined shot sleeve of claim 15, wherein said end collar means is further adapted to preclude relative axial movement of said elongated ceramic liner toward said first end of said main body portion to thereby keep said elongated ceramic liner securely retained within said main body portion.

17. The lined shot sleeve of claim 16, wherein said end collar means comprises an interference portion that extends inwardly toward said first longitudinal axis, said interference portion defining a terminal bore of substantially the same diameter as the cylinder bore of said elongated ceramic liner.

18. The lined shot sleeve of claim 17, wherein said second end of said end collar means is adapted for threadible engagement onto the first end of said main body portion.

19. The lined shot sleeve of claim 1, wherein said end collar means includes at least one runner therein, said runner being adapted to permit the axial flow of said molten metal from said terminal bore to the cavity of said metal mold.

20. The lined shot sleeve of claim 19, wherein said at least one runner extends from said second end of said end collar means to said first end of said end collar member.

21. The lined shot sleeve of claim 1, wherein said end collar means is adapted to withstand 14,000 psi internal pressure.

22. The lined shot sleeve of claim 1, wherein said end collar means comprises a second elongated ceramic liner therein.

* * * * *